United States Patent [19]

Pogwizd

[11] 3,997,092

[45] Dec. 14, 1976

[54] PAINT CONTAINER CARRIER

[76] Inventor: Kenneth W. Pogwizd, 6730 South Madison St., Hinsdale, Ill. 60521

[22] Filed: Nov. 18, 1974

[21] Appl. No.: 524,382

[52] U.S. Cl. ..... 224/5 A; 224/5 W; 224/26 R; 206/814; 248/346.1

[51] Int. Cl.[2] ..... B65D 21/00

[58] Field of Search ..... 224/26 R, 5 R, 5 A, 224/5 B, 5 G, 5 H, 5 Q, 5 MA, 5 V, 5 W, 26 B; 248/346.1, 310, 149; 220/17; 206/814, 523; 215/236

[56] References Cited

UNITED STATES PATENTS

| | | | |
|---|---|---|---|
| 119,400 | 9/1871 | Penrose | 224/11 |
| 1,109,161 | 9/1914 | Chindgren | 224/5 A |
| 1,470,334 | 10/1923 | Stensgaard | 224/5 |
| 1,806,477 | 5/1931 | Lloyd et al. | 224/25 R X |
| 2,552,397 | 5/1951 | Bretney | 215/236 |
| 2,613,804 | 10/1952 | Hughes | 220/17 X |
| 2,717,109 | 9/1955 | Walsh | 224/5 A |
| 2,753,094 | 7/1956 | Haney | 224/5 A |
| 2,995,281 | 8/1961 | Dixon | 224/25 R |
| 3,347,354 | 10/1967 | West | 206/523 X |
| 3,467,243 | 9/1969 | Butcher | 206/814 X |
| 3,535,709 | 10/1970 | Johannes | 224/5 B X |
| 3,642,239 | 2/1972 | Zeiler | 248/210 |

*Primary Examiner*—Robert J. Spar
*Assistant Examiner*—Jerold M. Forsberg
*Attorney, Agent, or Firm*—Alter and Weiss

[57] ABSTRACT

An improved paint container carrier for holding a container of paint having a contoured shape to conform to the contour of the user's body. The container further as a pivotally mounted lid for preventing spills and contamination of paint and straps for securing the device to the user's body. An adapter sleeve is provided so that the paint container carrier may receive various sizes of paint containers.

5 Claims, 6 Drawing Figures

FIG.1
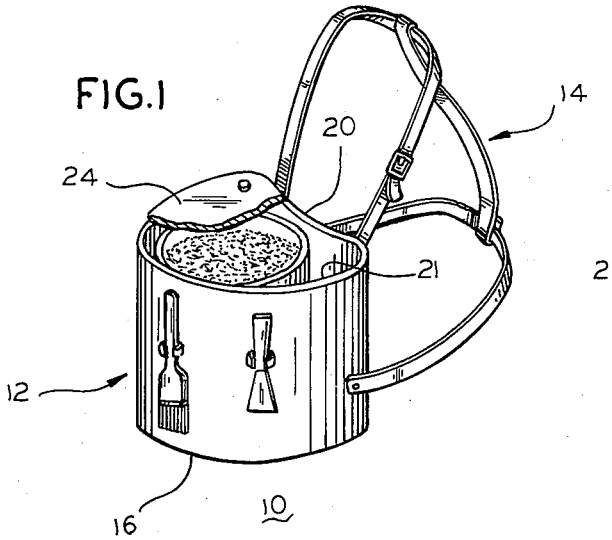
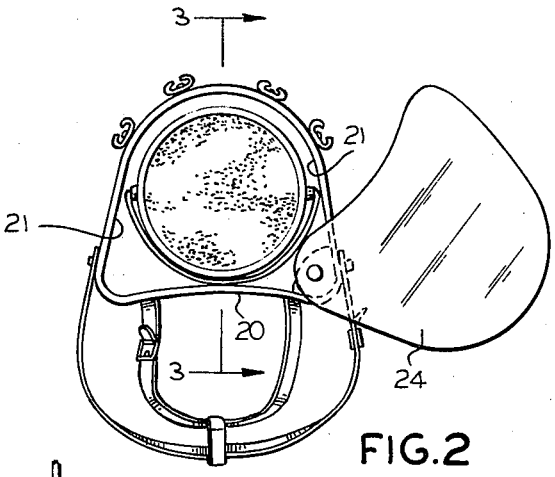
FIG.2
FIG.3
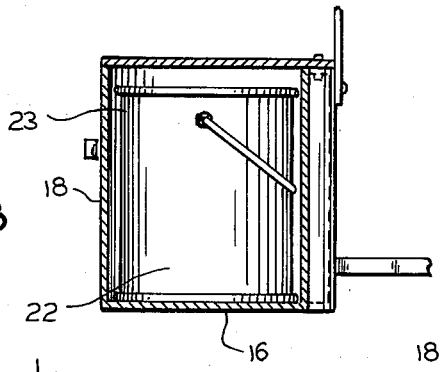
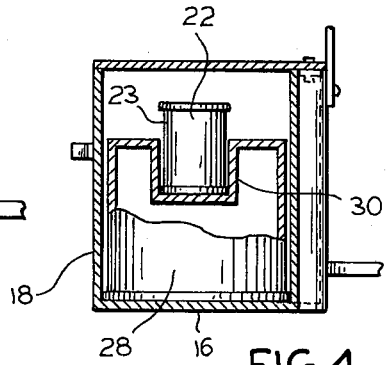
FIG.4
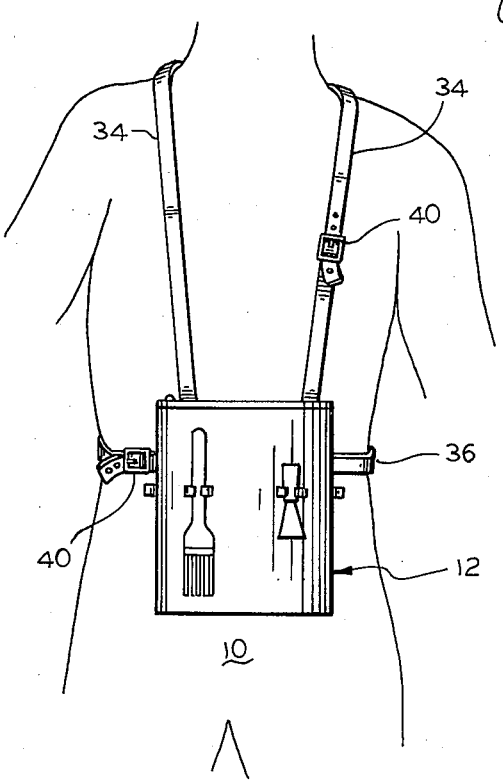
FIG.5
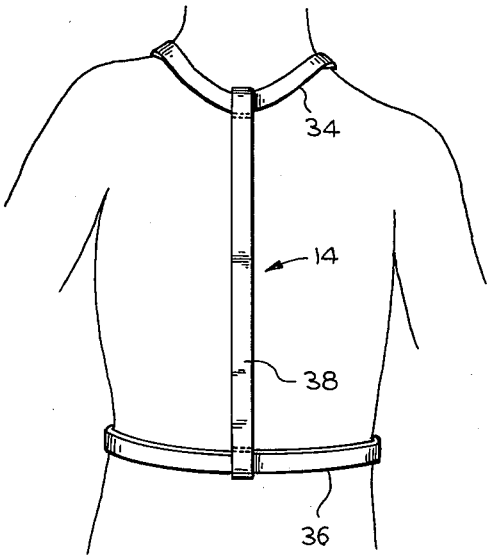
FIG.6

PAINT CONTAINER CARRIER

This invention relates to painting equipment, and/or particularly to a device for transporting a container of paint.

Up until now it has been customary for painters, both professional and amateur to use the same or similar containers in which paint, varnish, or other similar products are supplied by the manufacturer as a receptacle into which the brush is dipped during the process of painting a structure. As used herein, the term "paint container" is intended to cover all types of finishes which are applied by the use of a brush or other similar tool. These paint containers come in various sizes, the most popular in the United States being of the pint, quart, or gallon size.

The paint container is either hung upon a ladder rung by means of a hook, or is placed upon the scaffold or any other available supporting means in the vicinity of the work to be painted.

It has been necessary to move the paint container from place to place as the work has progressed. This involves stooping or bending over in order to dip the brush at intervals to replenish the user's supply of paint. The stooping and bending is perhaps the most fatiguing part of a painter's work, and the extra effort thereby made necessarily results in a considerable waste of time and extreme fatique prior to completion of the job.

It should also be noted that in the painting of exterior structures, such as buildings, iron structures, and the like, the painter is required to climb ladders and work from scaffolds and the like. It is not only inconvenient for a painter to transport his paint containers and tools from place to place, but also by reason of the unstable supporting structures, very serious accidents may also occur. For example, the painter is hampered in his movement on a scaffold since his paint container and tools may be left on the scaffold, thereby requiring movement of them from place to place as the work progresses.

Further, if the paint container remains open during the job, it may become contaminated by water, pollutants and other materials in the area. While it is possible to reseal the paint container after each replenishing of the supply of paint on the painter's brush, this results in extra work and thus extra time consumption.

Similarly, it has been customary for painters to carry around their tools such as scrapers, brushes, and dusters in the pockets of their overalls or to leave them in a place in the vicinity of the working area. In the former case, the tools are easily contaminated and after a single use of a particular paint brush, it is quite undesirable to replace it in the painter's overall. Further, amateurs may not have overalls with sufficient pockets to contain the various painting tools. In the latter case, the tools may become contaminated or may result in the application of paint to surfaces not intended to be painted.

Heretofore, efforts to make paint carriers have not met with great success. The prior art has intended to provide paint carriers with strapping means which lack stability and adaptability to receive various sizes of paint containers. Further, they have not provided a means of preventing contamination of the paint while on the job. Thus, there is a need for a simple device which allows the painter to have his paint and other tools in close proximity to his work while maintaining a relatively high degree of stability and flexibility.

Accordingly, an object of this invention is to provide a device which is particularly adapted to the use of painters working on structures such as buildings, bridges, and the like in such manner that the paint container can be safely transported and the painter has free use of his hands.

Another object of this invention is to provide an improved paint container carrier which holds a paint container and tools in close proximity to the painter.

Yet another object of this invention is to provide an improved paint container carrier which may be adapted to receive various sizes of paint containers.

Still another object of this invention is to provide an improved paint container carrier at a convenient height so that the painter will not have to stoop and bend thereby lessening fatigue.

In keeping with an aspect of this invention, these and other objects are accomplished by providing a contoured receptacle having a strapping assembly comprising several straps which fit over the neck and around the waist of the user. The shape of the receptacle conforms to the contour of the painter's body. A paint container fits snugly within the contoured receptacle and a pivotally mounted lid is provided to reduce the possibility of spilling or contaminating the paint. Further, an adapter sleeve is provided which fits snugly within the receptacle to adapt the paint container carrier to receive smaller sized paint containers.

The nature of the preferred embodiment will be understood best from a study of the attached drawings, wherein:

FIG. 1 is a perspective view of the improved paint container carrier;

FIG. 2 is a top plan view of the carrier specifically showing the contoured shape and the lid in an open position;

FIG. 3 is a side elevation view taken along line 3—3 of FIG. 2;

FIG. 4 is a side elevation view taken along line 3—3 of FIG. 2 specifically showing the inventive adapter sleeve;

FIG. 5 is a front view of the improved paint container carrier secured to a user; and FIG. 6 is a view of the strapping assembly as secured to the user.

The improved paint container assembly 10 of FIG. 1 comprises a contoured paint container receptacle 12 and a strapping assembly 14 for securing receptacle 12 to the user.

As best shown in FIGS. 2 and 3, receptacle 12 includes a base surface 16 and a closed cylindrical side surface 18. The side surface 18 includes a contoured portion 20 which is positioned against the stomach of the painter in order to increase the stability of the carrier, thereby lessening the risk of spilling the contents of the paint container positioned therein.

The interior dimensions of receptacle 12 are designed to permit a paint container 22 to fit snugly therein. That is to say, the cylindrical side wall 23 of the paint container 22 abuts against a substantial portion of the carrier surface 21 of receptacle 12.

Receptacle 12 may be of any suitable size to receive a particular size paint container 22. For example, receptacle 12 may be adapted to hold a 1-gallon paint container commonly sold and used throughout the United States. The diameter of the paint container 22 is substantially equal to the inner diameter of receptacle 12 so that it fits snugly therein. Similarly, the depth of the paint container 22 is at least slightly greater than the depth of receptacle 12 so that container 22 fits completely therein.

Receptacle 12 further includes a slideable lid 24. Lid 24 is pivotally mounted to receptacle 12 by suitable means such as hinge 26. Lid 24 may be swivelled from a closed position which completely covers the top of receptacle 12, thereby lessening the chance of spilling the contents of the paint container or paint contamination, to an open position to obtain access to the paint.

As best shown in FIG. 5, sleeve 28 is provided to adapt receptacle 12 to receive various smaller sizes of paint containers 22. Sleeve 28 includes a cylindrical portion 29 and a recessed portion 30. The diameter of the sleeve 28 as well as the depth is controlled by the size of the paint container 22. For example, the diameter of sleeve 28 may be substantially equal to the diameter of a standard 1-gallon paint container so that the paint container fits snugly within the receptacle 12 without sleeve 28. A sleeve 28 is provided having a diameter substantially equal to the diameter of the standard 1-gallon paint container so that sleeve 28 fits snugly inside receptacle 12. The diameter of recessed portion 30 is substantially equal to the diameter of a smaller paint container such as the 1-quart size. The depth of recessed portion 30 is great enough to maintain the quart container in a snug relation with the walls of recessed portion 30. Various sleeves, each having a different size recessed portion, may be used to adapt one size of receptacle to receive various sizes of paint containers.

Receptacle 12, lid 24, and sleeve 28 may all be constructed of any rigid material such as aluminum, plastic or sheet metal. Clip means are provided on the exterior cylindrical side surface 18 of receptacle 12 for securing various paint tools such as scrapers, brushes and dusters for easy accessibility by the painter.

Strapping assembly 14 includes a top or shoulder strap 34, a waist strap 36 and a back strap 38. The waist strap 36 and the shoulder strap 34 are attached to the receptacle 12 suitable fastening means such as rivets 38. The shoulder and waist straps 34 and 36, respectively, have adjusting means such as buckle 40 to permit the regulation of the size and position of carrier 10. The straps 14 may be made from various types of materials, such as polyurethane, which is strong yet comfortable to the user.

When the receptacle is secured to the body of the user, as best shown in FIGS. 5 and 6, the paint container 22 is placed in receptacle 12 thereby placing its contents within easy reach. The possibility of spilling the container's contents is lessened by the contoured shape of receptacle 12, while clip means 32 provide a place for securing various paint tools within the easy reach of the user.

Those who are skilled in the art will readily perceive many alternative uses and modifications of the invention. While the principles of the invention have been described above in connection with specific embodiments, it is to be understood that this description is made only by way of example and not as a limitation on the scope of the invention. Thererfore, the appended claims are to be construed to cover all equivalent structures.

I claim:

1. A paint container carrier for securing a paint container to the body of the user, said carrier comprising a receptacle for holding the paint container having a contoured side substantially conforming to the user's body, said paint container fitting into said receptacle and enclosed therein;

a strapping assembly means;

means for securing said strapping assembly means to said receptacle, so that the contoured side of said receptacle engages the body of the user, said strapping assembly means comprising a top shoulder strap which is secured over the neck of the user, a waist strap secured around the waist of the user;

and a back strap which braces said top shoulder strap to said waist strap at the back side of the user, the inner dimension of said receptacle substantially equal in size to the container diameter of a standard paint container so that said standard paint container fits snugly therein, sleeve means for adapting said receptacle to receive paint containers smaller in diameter than said inner dimension of said receptacle so that said smaller containers fits snugly therein, and said paint container carrier having a lid across the top of said receptacle and means for securing said lid to said receptacle.

2. The paint container of claim 1 wherein said means for securing said lid to said receptacle comprises a pivot means adjacent to an end of said contoured side of said receptacle, said pivot means enabling said lid to be swivelled laterally to any position from a closed position covering said paint container to an open position away from said paint container, said lid remaining substantially parallel to the top and bottom sides of said paint container as it is swivelled.

3. The paint container carrier of Claim 1 further comprising means for attaching painting tools to the outer side of said receptacle opposite said contoured side.

4. The paint container carrier of claim 3 wherein said attachment means comprises a plurality of clips; and means for securing said clips to the side surface of said receptacle.

5. A paint container carrier for securing a paint container to the body of a user, said carrier comprising:

a receptacle for holding the paint container, having a contoured side substantially conforming to the user's body;

said paint container fitting into said receptacle and enclosed therein, the inner diameter of said receptacle substantially equal to the diameter of said paint container so that said paint container fits snugly therein;

strapping assembly means which is secured around the body of the user;

means for securing said strapping assembly means to said receptacle, so that the contoured side of said receptacle engages the body of the user;

a lid across the top of said receptacle held by pivot means to the top of said receptacle, thereby enabling said lid to be swivelled laterally from a closed position to an open position while said lid remains substantially parallel to the top and bottom sides of said paint container as it is swivelled;

attachment means attached to the exterior of said receptacle for attaching painting tools thereto; and removable sleeve means comprising a spacer sleeve having an outer dimension substantially equal to the interior dimension of said receptacle, and a recessed portion to receive a smaller paint container, thereby enabling the smaller paint container to fit snugly within said sleeve means and in turn within said receptacle.

* * * * *